US011737525B2

(12) United States Patent
Rosengarten

(10) Patent No.: US 11,737,525 B2
(45) Date of Patent: Aug. 29, 2023

(54) WATCHBAND

(71) Applicant: 4 Thumbs, LLC, Southampton, NY (US)

(72) Inventor: Gerald Rosengarten, Southampton, NY (US)

(73) Assignee: 4 Thumbs, LLC, Southampton, NY (US)

( * ) Notice: Subject to any disclaimer, the term of this patent is extended or adjusted under 35 U.S.C. 154(b) by 188 days.

(21) Appl. No.: 17/395,539

(22) Filed: Aug. 6, 2021

(65) Prior Publication Data

US 2022/0053894 A1 Feb. 24, 2022

Related U.S. Application Data

(60) Provisional application No. 63/066,907, filed on Aug. 18, 2020.

(51) Int. Cl.

| | |
|---|---|
| ***A44C 5/14*** | (2006.01) |
| ***A44C 5/12*** | (2006.01) |
| ***A44C 5/18*** | (2006.01) |

(52) U.S. Cl.

CPC ..... *A44C 5/147* (2013.01); *A44C 5/12* (2013.01); *A44C 5/185* (2013.01)

(58) Field of Classification Search

CPC .. G04B 37/1486; G04B 47/046; G04B 37/16; G04B 37/12; A44C 5/185; A44C 5/12; A44C 5/147; A44C 5/14

See application file for complete search history.

(56) References Cited

U.S. PATENT DOCUMENTS

| | | | | |
|---|---|---|---|---|
| 3,968,643 | A * | 7/1976 | Curtil | A44C 5/14 368/282 |
| 4,060,185 | A | 11/1977 | Kuroda | |
| 4,645,102 | A * | 2/1987 | Proellochs | G04B 37/1486 968/351 |
| 6,779,917 | B1 | 8/2004 | Chappuis | |

(Continued)

FOREIGN PATENT DOCUMENTS

| | | | |
|---|---|---|---|
| DE | 2547776 | A1 | 5/1976 |
| DE | 202006012832 | U1 | 10/2006 |

(Continued)

OTHER PUBLICATIONS

European Search Report issued in Appln. No. 21191462.7 dated Jan. 2, 2022 (2 pages).

*Primary Examiner* — Edwin A. Leon

(74) *Attorney, Agent, or Firm* — Lerner David LLP

(57) ABSTRACT

A watchband for a watch case that has straight upper and lower edges, each edge having a channel, and a cylindrical boss protruding from a back surface of the watch case. The watchband includes a mounting structure including a base having an aperture therein, and first and second bars connected to the base. A bracelet extends in an elongation direction between a first end connected to the mounting structure and a free end spaced from the mounting structure. When the watch case is assembled to the watchband, the first bar is positioned in one of the channels, the second bar is positioned in another one of the channels, and the cylindrical boss is positioned in the aperture. Optionally, the bracelet may include a hinge to facilitate application of the watchband to a user's wrist.

20 Claims, 11 Drawing Sheets

(56) References Cited

U.S. PATENT DOCUMENTS

| | | | | |
|---|---|---|---|---|
| D784,346 | S * | 4/2017 | Tao | D10/128 |
| 10,058,148 | B1 | 8/2018 | Wittenberg et al. | |
| 10,058,149 | B1 | 8/2018 | Wittenberg et al. | |
| 10,175,653 | B1 | 1/2019 | Bloom et al. | |
| 10,327,520 | B1 | 6/2019 | Ely | |
| 10,610,157 | B2 | 4/2020 | Pandya et al. | |
| 10,849,392 | B1 | 12/2020 | Wittenberg et al. | |
| 10,987,054 | B2 | 4/2021 | Pandya et al. | |
| 2013/0088943 | A1 | 4/2013 | Teixeira | |
| 2018/0084873 | A1 | 3/2018 | Kallman et al. | |
| 2019/0341677 | A1 | 11/2019 | Hsu et al. | |
| 2020/0029660 | A1 | 1/2020 | Wu et al. | |

FOREIGN PATENT DOCUMENTS

| | | |
|---|---|---|
| EP | 1 070 997 A1 | 1/2001 |
| JP | S56 30013 U | 3/1981 |

* cited by examiner

WATCHBAND

CROSS-REFERENCE TO RELATED APPLICATIONS

This application claims the benefit of the filing date of U.S. Provisional Patent Application No. 63/066,907, filed Aug. 18, 2020, the disclosure of which is hereby incorporated herein by reference.

FIELD OF THE INVENTION

The present invention is directed to watchbands. More particularly, the present invention is directed to watchbands that are quickly and easily applied to and removed from a user's wrist.

BACKGROUND OF THE INVENTION

Wristwatches typically have a case that includes the working mechanism or movement of the watch, and a watchband used to apply the watch to the user's wrist. Watchbands are available in a variety of sizes, shapes, colors and styles. Some watchbands are in the form of a rigid bracelet that fits loosely around the user's wrist. Other watchbands are in the form of interconnected links that can be tightened around a user's wrist, either mechanically through a clasp or elastically. Still other watchbands are in the form of a pair of straps that attach to opposite sides of the watch case. The straps can be wrapped around a user's wrist and their free ends can be secured to one another by a buckle, hook and loop fastener, snap fastener or other connector.

Despite the variety of watchbands currently available, there is a need for a watchband that can readily receive and hold a watch case, in particular a watch case for a multi-function smart watch. There is a further need for such a watchband that can quickly and easily be applied to and removed from the wrist of the user. The present invention may address this and other needs.

SUMMARY OF THE INVENTION

One aspect of the present invention provides a watchband for a watch case. The watch case has straight upper and lower edges, each of the edges having a channel, and a cylindrical boss protruding from a back surface of the watch case. The watchband includes a mounting structure and a bracelet extending in an elongation direction between a first end connected to the mounting structure and a free end, the free end being spaced from the mounting structure. The mounting structure includes a base having a front surface, a rear surface, an aperture extending from the front surface to the rear surface, and first and second bars connected to the base at positions spaced from the front surface. The first bar is oriented parallel to the second bar in a direction orthogonal to the elongation direction of the bracelet.

Another aspect of the present invention provides a watch including a watch case and a watchband. The watch case has straight upper and lower edges, each of the edges having a channel, and a cylindrical boss protruding from a back surface of the watch case. The watchband includes a mounting structure and a bracelet extending in an elongation direction between a first end connected to the mounting structure and a free end, the free end being spaced from the mounting structure. The mounting structure includes a base having a front surface, a rear surface, an aperture extending from the front surface to the rear surface, and first and second bars connected to the base at positions spaced from the front surface. The first bar is oriented parallel to the second bar in a direction orthogonal to the elongation direction of the bracelet. The watch case is connected to the watchband so that the first bar is positioned in one of the channels, the second bar is positioned in another one of the channels, and the cylindrical boss is positioned in the aperture.

BRIEF DESCRIPTION OF THE DRAWINGS

A more complete appreciation of the subject matter of the present invention and the various advantages thereof can be realized by reference to the following detailed description in which reference is made to the accompanying drawings in which.

DETAILED DESCRIPTION

Figure 1:
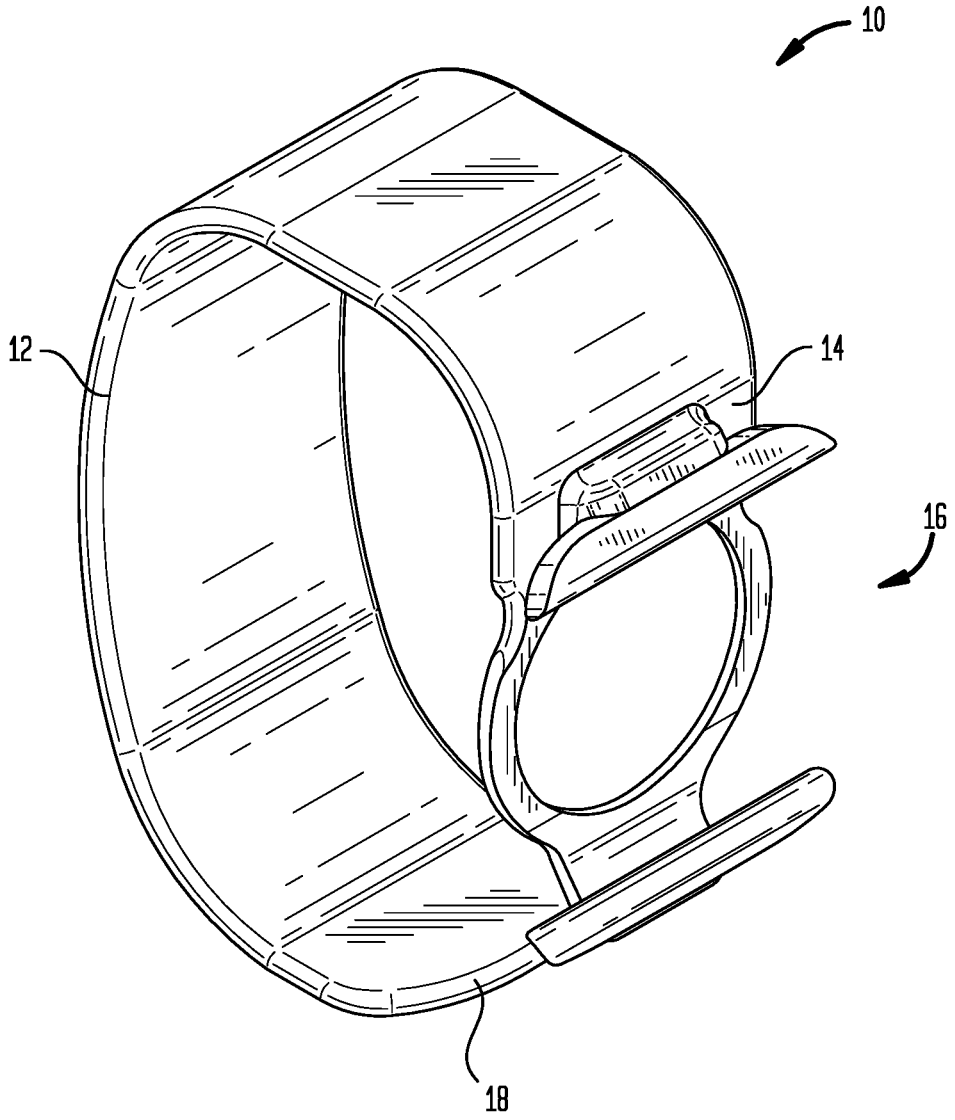
FIG. 1 is a front perspective view of a watchband according to the present invention.
Figure 2:
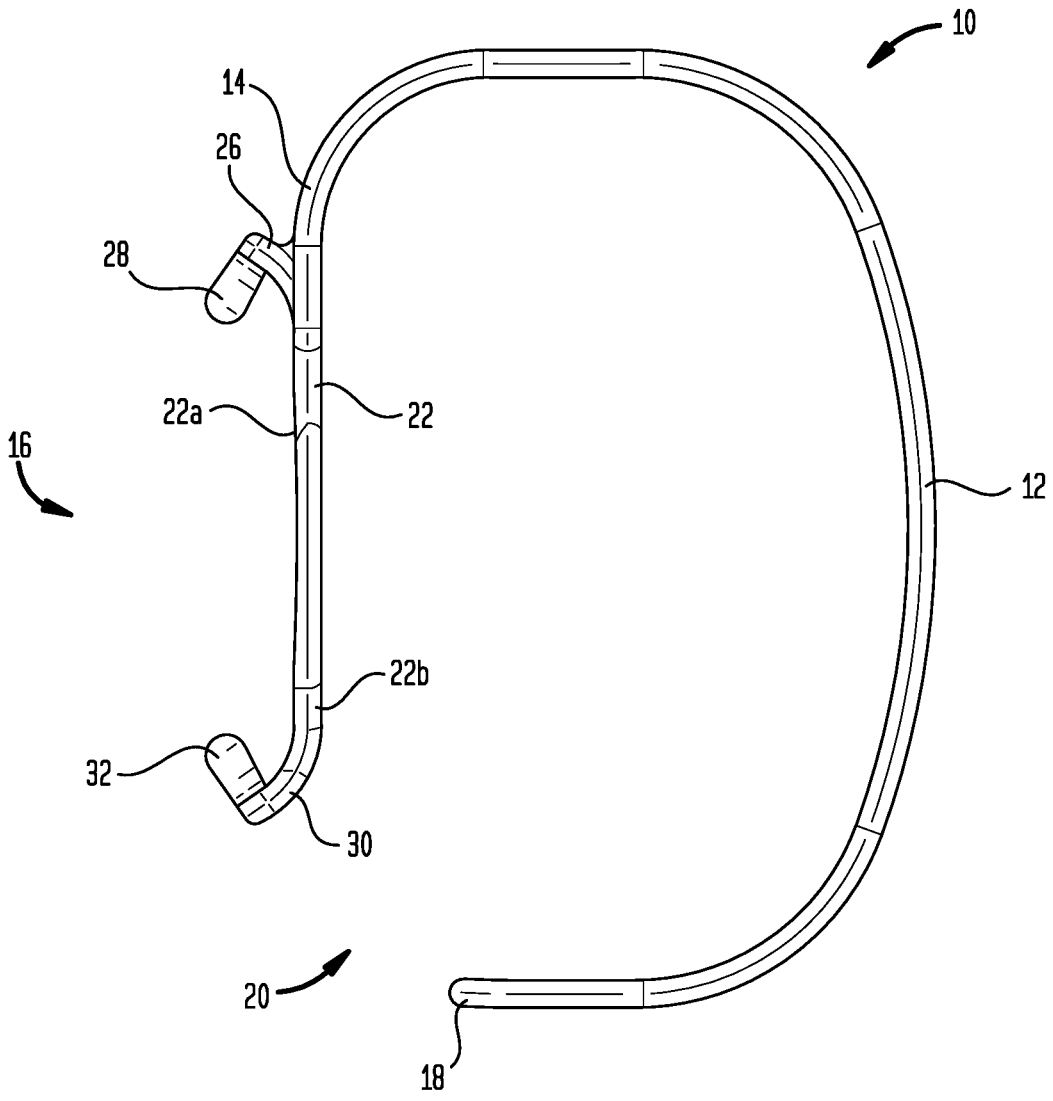
FIG. 2 is a side elevational view of the watchband of FIG. 1.
Figure 3:
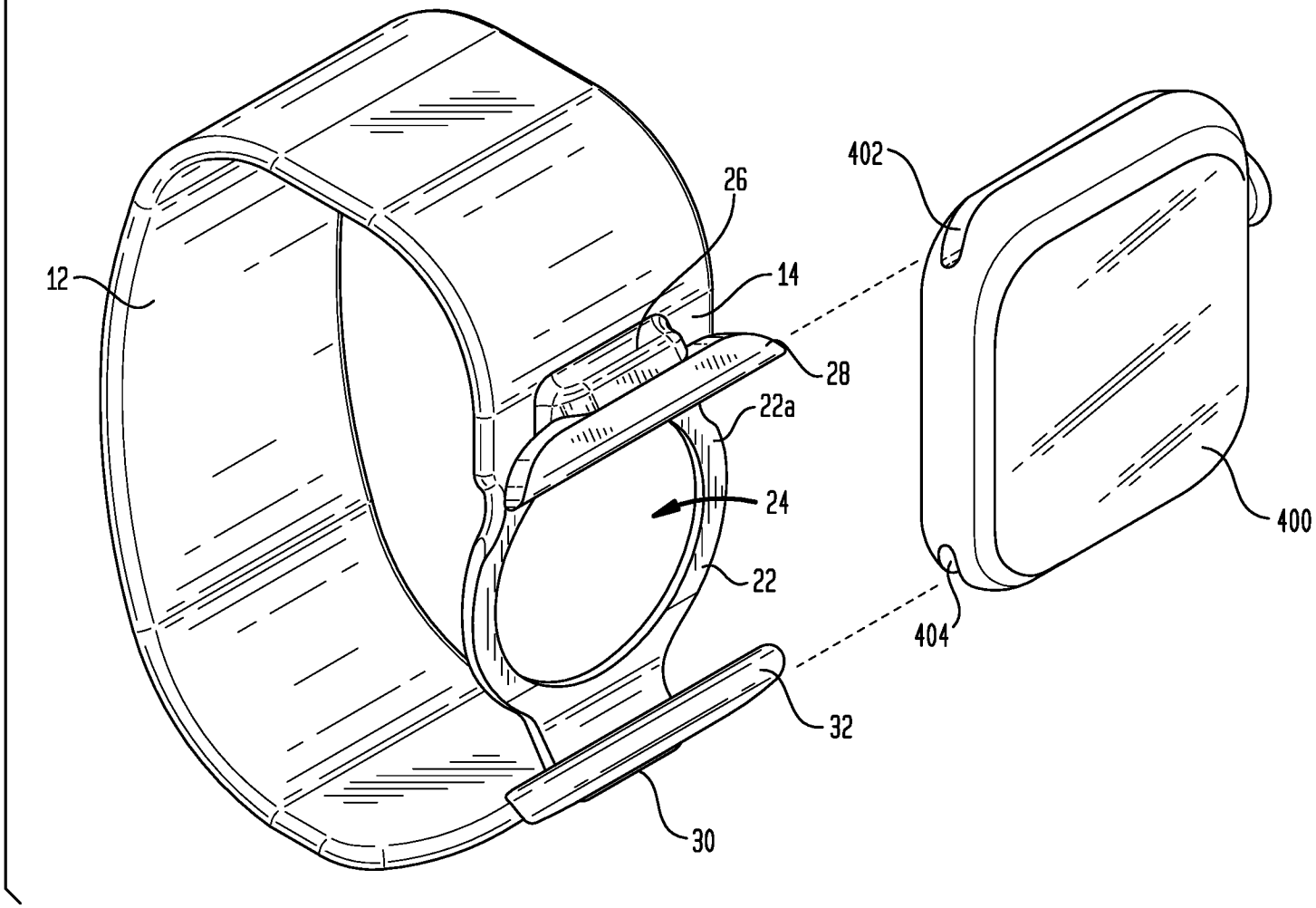
FIG. 3 is an exploded perspective view showing a watch case prior to assembly to the watchband of FIG. 1.
Figure 4:
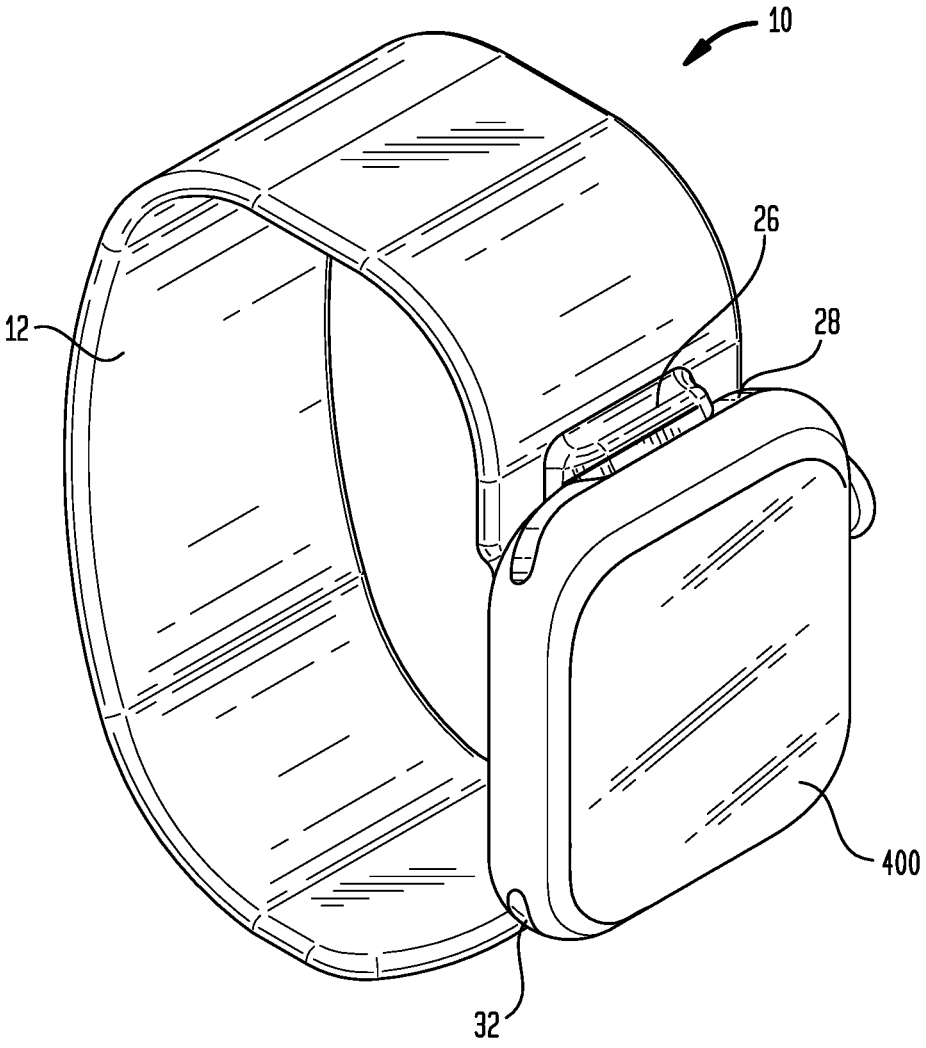
FIG. 4 is a front perspective view of the watchband and watch case of FIG. 3 in assembled relationship.

A watchband 10 according to one embodiment of the present invention is shown in FIGS. 1-3. Watchband 10 includes an open bracelet 12. At one end 14, bracelet 12 includes a mounting structure 16 for receiving a watch case 400 and securing it in assembled relationship to the bracelet. The other end 18 of bracelet 12 is spaced from mounting structure 16 so as to define an opening 20 through which a user may insert his or her wrist. In that regard, the end 18 of bracelet 12 preferably has a smoothly curved contour so as to not present any sharp corners or edges that could potentially injure the user when applying the watchband 10 to his or her wrist. Watchband 10, and in particular bracelet 12, is preferably formed from a material that flexes or that may be deformed, enabling end 18 to be moved away from structure 16 to facilitate the application of watchband 10 to the user's wrist. Once watchband 10 has been applied to the user's wrist, bracelet 12 may be biased to return to its original position or may be manually deformed back to its original position to thereby hold the watchband securely to the arm of the user. Materials for forming watchband 10 include metals, polymers and rubber. Examples of acceptable metals include stainless steel, brass, copper, silver, gold, platinum and titanium, or a base metal plated with brass, copper, titanium or a precious metal. Particularly preferred are relatively rigid polymers that are capable of being deflected from a starting condition without breaking, and that will then return to the starting position upon removal of the deflecting force. Examples of such polymers include resin, nylon, and polyester. Bracelet 12 formed from any of the foregoing materials may be decorated to enhance its appearance. For example, the bracelet material may be covered in leather, the outer surface of the bracelet may be textured, painted or otherwise decorated, or the watchband may be formed from a colored polymer or rubber.

Figure 5:
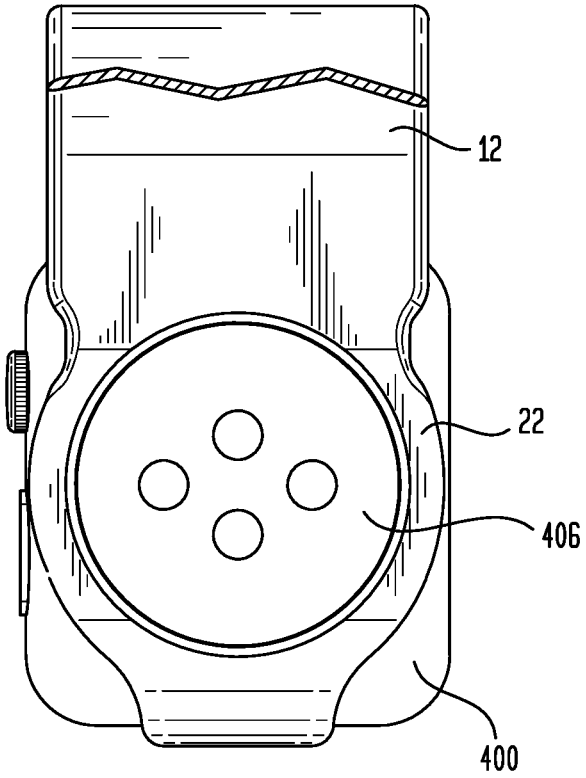
FIG. 5 is a partial rear view of the watchband and watch case as shown in FIG. 4.
Figure 6:
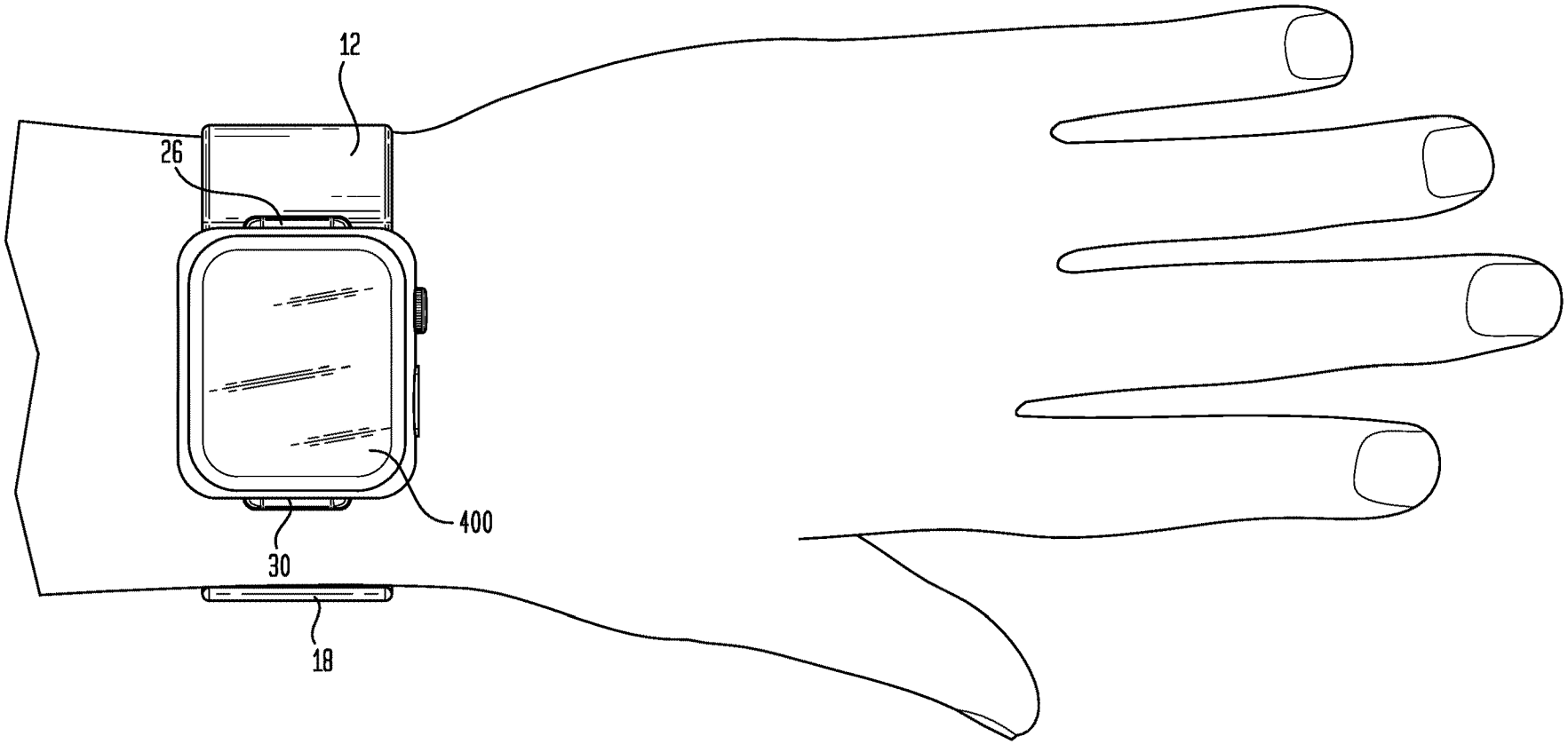
FIG. 6 is a front view of the watchband and watch case shown in FIG. 4 worn on the wrist of a user.

Structure 16 has features that are intended to mate with corresponding features of watch case 400 in order to assemble the watch case to watchband 10 and hold it securely in place thereon. In that regard, referring to FIG. 3, watch case 400 has a generally rectangular or square profile with a channel 402 along a substantially straight top edge and another channel 404 along a substantially straight bottom edge. A cylindrical boss 406 (FIG. 5) protrudes from the back surface of watch case 400. It is intended that boss 406 contacts the wrist of the user when the watch is worn and obtains physiological information from the user for use in various functions of the watch. Watch case 400 is held in place on watchband 10 by mating the features of the watch case to features of mounting structure 16.

More particularly, mounting structure 16 has a base 22 having a front surface 22*a* and a rear surface 22*b*. A large aperture 24 extends through base 22 from front surface 22*a* to rear surface 22*b*, the aperture being sized to receive cylindrical boss 406 of watch case 400. Between aperture 24 and the end 14 of bracelet 12, mounting structure 16 includes a stanchion 26 supporting a bar 28 at a spaced distance from the front surface 22*a* of base 22 and oriented in a direction transverse to the elongation direction of bracelet 12. On the opposite side of aperture 24, mounting structure 16 includes a second stanchion 30 that supports a second bar 32 at a spaced distance from the front surface 22*a* of base 22 and oriented in a direction transverse to the elongation direction of bracelet 12. In some embodiments, bracelet 12 and all the features of mounting structure 16 may be integrally formed from the same material, whether metal, polymer or rubber. In other embodiments, bracelet 12 may be formed from one material, while mounting structure may be formed from a different material, and the two components may be assembled to one another in any known fashion.

It is a simple procedure to assemble watch case 400 to watchband 10. To do so, watch case 400 is positioned on one side of mounting structure 16 such that channel 402 is aligned with bar 28 and channel 404 is aligned with bar 32. Once properly aligned, watch case 400 may be slid in a direction orthogonal to the elongation direction of bracelet 12 (i.e., parallel to bars 28 and 32) until bar 28 begins to slide into channel 402 and bar 32 begins to slide into channel 404. As watch case 400 and mounting structure 16 continue to move toward one another, the cylindrical boss 406 on the back of the watch case may cause base 22 to deflect away from the back of the watch case. Watch case 400 is slid relative to mounting structure 16 until the watch case is centered on the mounting structure, at which point the boss 406 on the back of watch case 400 will protrude into aperture 24 and bars 28 and 32 will be centered within channels 402 and 404, respectively. Base 22 has a thickness such that boss 406 is at least flush with, or protrudes out from, the rear surface 22*b* of base 22. The engagement of bars 28 and 32 within channels 402 and 404, respectively, holds watch case 400 in assembled position on watchband 10 and the engagement of boss 406 within aperture 24 prevents the watch case from sliding off of the bars, thereby preventing the accidental or inadvertent disassembly of same. To disassemble watch case 400 from watchband 10, base member 22 may be pried slightly away from the back of the watch case to move boss 406 out from aperture 24, and the watch case may then be slid in either direction orthogonal to the longitudinal direction of bracelet 12 until these components are detached from one another. The ability to easily remove watch case 400 from watchband 10 and reassemble the watch case to another watchband enables a user to own a single watch case and multiple watchbands and simply exchange watchbands when it is desired to wear a watch with a different color, a different style or different ornamental features.

As noted previously, to place watchband 10 on the wrist of a user, the user simply moves the end 18 of bracelet 12 away from mounting structure 16. This enables the user to place watchband 10 on his or her wrist in one of two ways. If a large enough space is created within bracelet 12, the user may simply guide his or her hand through that space until the bracelet is positioned on the user's wrist. Alternatively, the user may insert his or her wrist directly through opening 20 until watchband 10 encircles the user's wrist. In either technique, once the watchband is positioned around the user's wrist, the free end 18 of bracelet 12 can be moved back toward mounting structure 16, either through the bias of the material forming bracelet 12 or through a compressive force exerted by the user.

Figure 7:
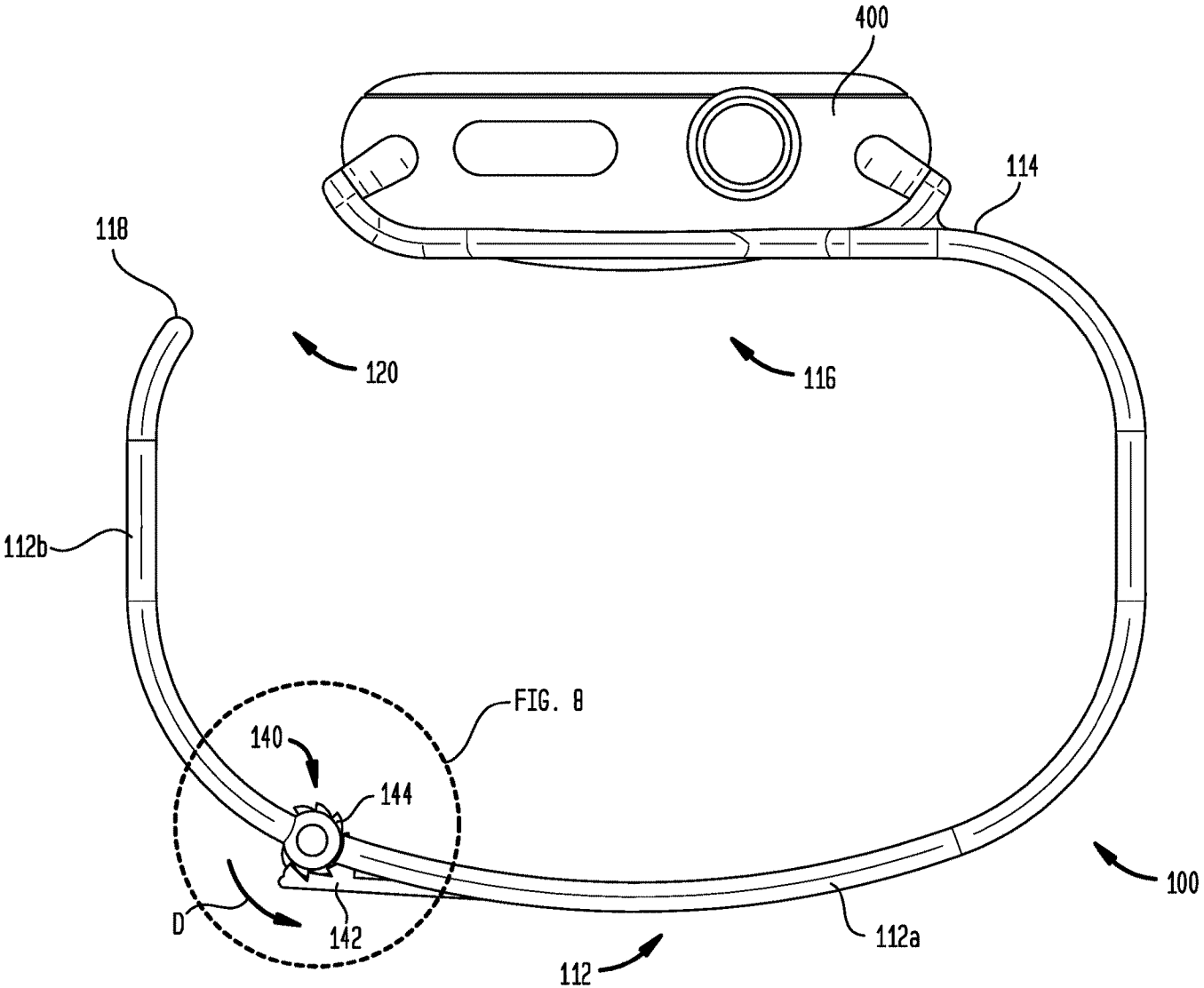
FIG. 7 is a side elevational view of a watchband incorporating a hinge according to an alternate embodiment of the present invention.
Figure 8:
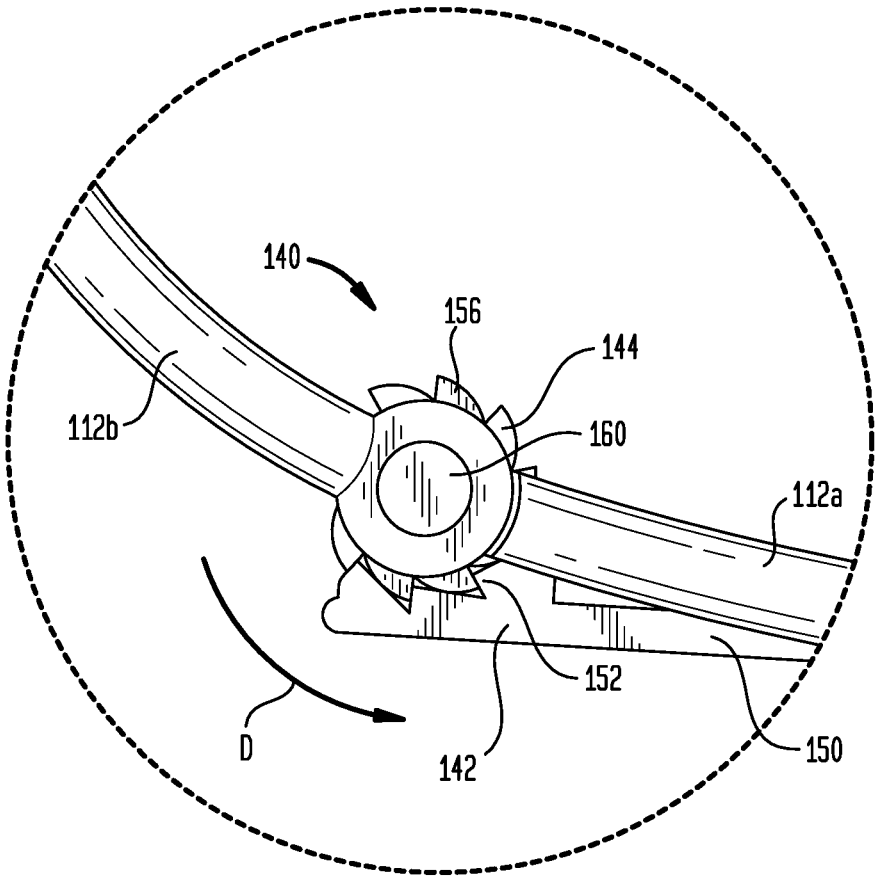
FIG. 8 is an enlarged view of the hinge of FIG. 7.
Figure 9:
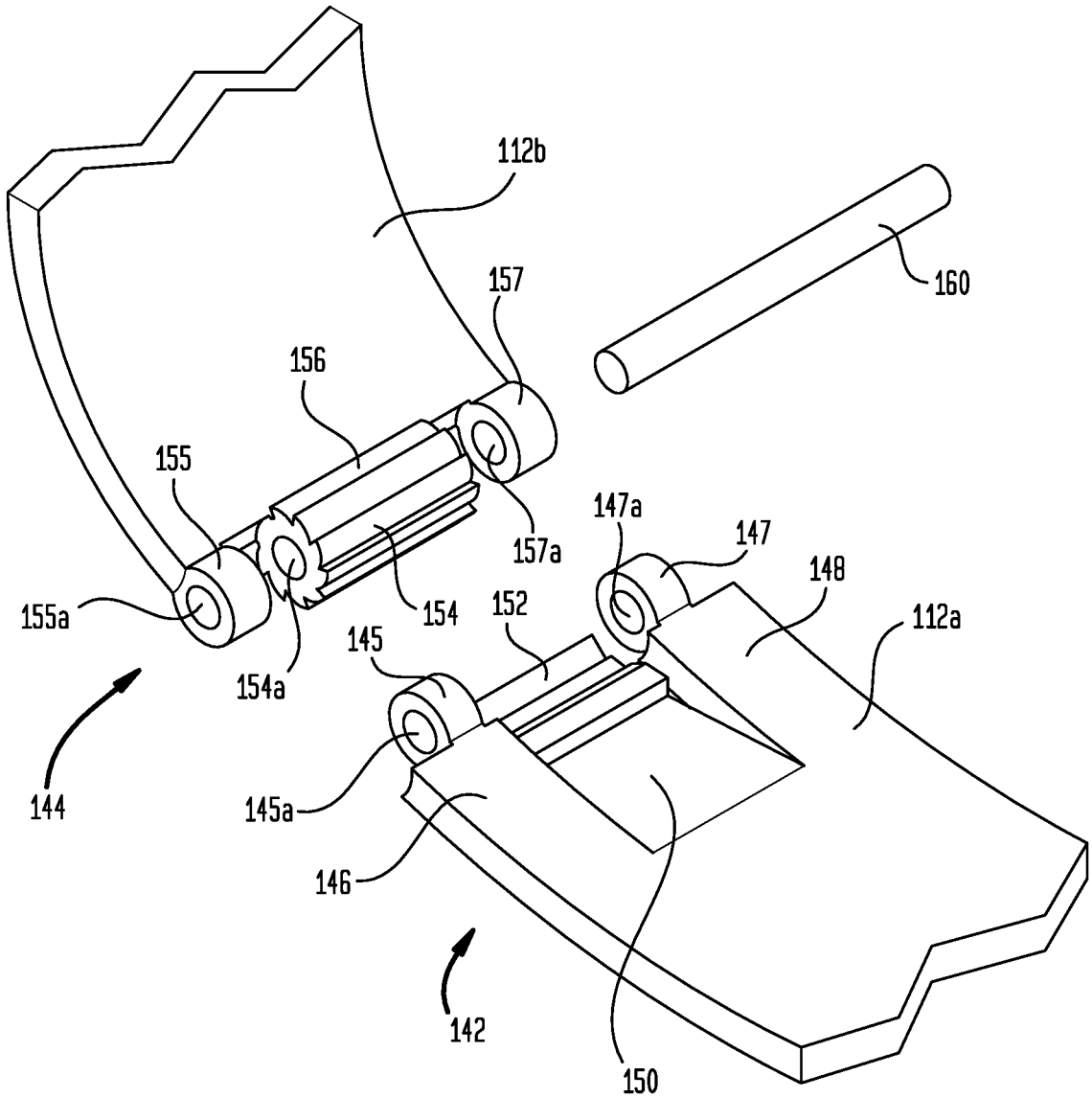
FIG. 9 is an enlarged exploded view of the hinge of FIG. 7.

When watchband 10 is formed from a more rigid material, such as a rigid polymer or metal, it may be more difficult for bracelet 12 to flex enough to enable a user to apply the watchband to his or her wrist. In such event, it may be beneficial to provide a hinge at some point along the length of bracelet 12. One embodiment of a watchband 100 incorporating a hinge 140 is shown in FIG. 7.

Watchband 100 is substantially similar to watchband 10 described above, and includes bracelet 112 and mounting structure 116. Bracelet 112 is divided into two portions, a first portion 112*a* that extends from mounting structure 116 to hinge 140, and a second portion 112*b* that extends from hinge 140 to the free end 118 of the bracelet, leaving a space 120 between the free end of the bracelet and the mounting structure. Although hinge 140 can be placed anywhere along the length of bracelet 112, in this embodiment the hinge is positioned closer to the free end than to mounting structure 116, in a region at which the bracelet curves back toward the mounting structure.

Hinge 140 includes a first member 142 fixedly connected to an end of portion 112*a* of bracelet 112, and a second member 144 fixedly connected to an end of portion 112*b* of the bracelet. Member 142 includes a pair of arms 146, 148 that extend away from the end of bracelet portion 112*a* in the longitudinal direction of the bracelet. The free end of each arm 146, 148 includes a ring 145, 147, respectively, spaced laterally inward from the side edges of the arms and oriented in a direction orthogonal to the longitudinal direction of bracelet 112. Rings 145, 147 define colinear bores 145*a*, 147*a*, respectively. Between arms 146, 148, member 142 includes a flexible tab 150, the free end of which includes a plurality of shallow ridges or teeth 152 oriented in a direction orthogonal to the longitudinal direction of the bracelet. Tab 150 is positioned in hinge 140 so that it is free to flex toward the outside of bracelet 112, i.e., in a direction away from the wrist of the wearer. When watchband 100 is formed from a rigid material that will not enable tab 150 to flex even slightly relative to bracelet portion 112*a*, the tab may be attached to bracelet portion 112*a* by a hinge or a living hinge, or may be formed from a more flexible material and attached to the bracelet portion. Member 144 includes a gear 154 fixedly attached to an end of bracelet portion 112*b* and sized to be received between rings 145, 147. Gear 154 includes a plurality of shallow ridges or teeth 156 oriented in a direction orthogonal to the longitudinal direction of bracelet 112. An elongated bore 154*a* extends entirely through gear 154. Member 144 further includes a pair of rings 155, 157 defining a pair of colinear bores 155*a*, 157*a*, respectively, at spaced distances from the ends of gear 154 so as to define spaces for receiving rings 145, 147 in assembled relationship. Member 142 may be assembled to member 144 by positioning rings 145, 147 on either end of gear 154 and inwardly of rings 155, 157 so that bores 155*a*, 145*a*, 154*a*, 147*a* and 157*a* are aligned, and then inserting a pivot pin 160 through the aligned bores. In the assembled position of hinge 140, tab 150 will be flexed slightly outwardly and the teeth 152 on the tab will be engaged with the teeth 156 on gear 154. It should be noted that teeth 152 and 156 are directional, and thus provide a ratcheting function. That is, the engagement of teeth 152 with teeth 156 will permit bracelet portion 112*b* to pivot in an inward or closing direction relative to bracelet portion 112*a*, but will prevent portion 112*b* from pivoting in the outward or opening direction relative to portion 112*a*, as will be described further below.

In addition to being more difficult to apply to a user's wrist, watchbands formed from more rigid materials, such as watchband 100, may make it more difficult to assemble watch case 400 to the mounting structure 116 of the watchband. To help alleviate that issue, the base 122 of mounting structure 116 may include a thinned region (not shown) on one side of aperture 124. The thinned region may be large enough to accommodate the cylindrical boss 406 on the back of watch case 400, and may be thin enough to enable the watch case to be forced over the front surface 122*a* of base 122 until cylindrical boss 406 is positioned in aperture 124.

To place watchband 100 on the wrist of a user, the user may simply lift the tab 150 of member 142 in an outward direction until teeth 152 are disengaged from the teeth 156 of gear 154. At this point, bracelet portion 112*b* may be rotated in a counterclockwise direction D (as viewed in FIG. 7) about pin 160, increasing the space 120 between bracelet portion 112*b* and mounting structure 116. When space 120 is of a sufficient size, the user may release tab 150 to again engage teeth 152 with teeth 156, locking bracelet portion 112*b* from further outward rotation relative to bracelet portion 112*a*. The user may then apply watchband 100 by inserting his or her wrist through the enlarged space 120 into the interior of the watchband. Once watchband 100 is positioned around the user's wrist, the user may simply rotate bracelet portion 112*b* in a clockwise or inward direction relative to bracelet portion 112*a* (as viewed in FIG. 7), decreasing space 120. The user may rotate bracelet portion 112*b* until watchband 100 feels comfortable on the user's wrist, all without having to lift tab 150. Once the second portion 112*b* of the bracelet is in its final position, the engagement of teeth 152 with teeth 156 will lock the second portion in place relative to the first portion, preventing watchband 100 from reopening and accidently falling off the wrist of the user.

Although hinge 140 has been described in detail above, watchband 100 may include any type of hinge that enables the second portion 112*b* of bracelet 112 to rotate relative to the first portion 112*a* of the bracelet to apply the bracelet to a user's wrist, but that fixes the second portion relative to the first portion to hold the bracelet in place when worn. One example of such a hinge has a keyed hinge pin that may be removed to allow the second portion of the bracelet to rotate relative to the first portion, but that may be reinserted in one of several rotational positions to lock the second portion in place relative to the first portion. Another example of such a hinge may incorporate a relatively stiff spring that requires force to rotate the second portion of the bracelet relative to the first portion, but that biases the second portion back to a closed rest position once that force is removed. Any other hinge that performs the functions described above may be used.

Figure 10:
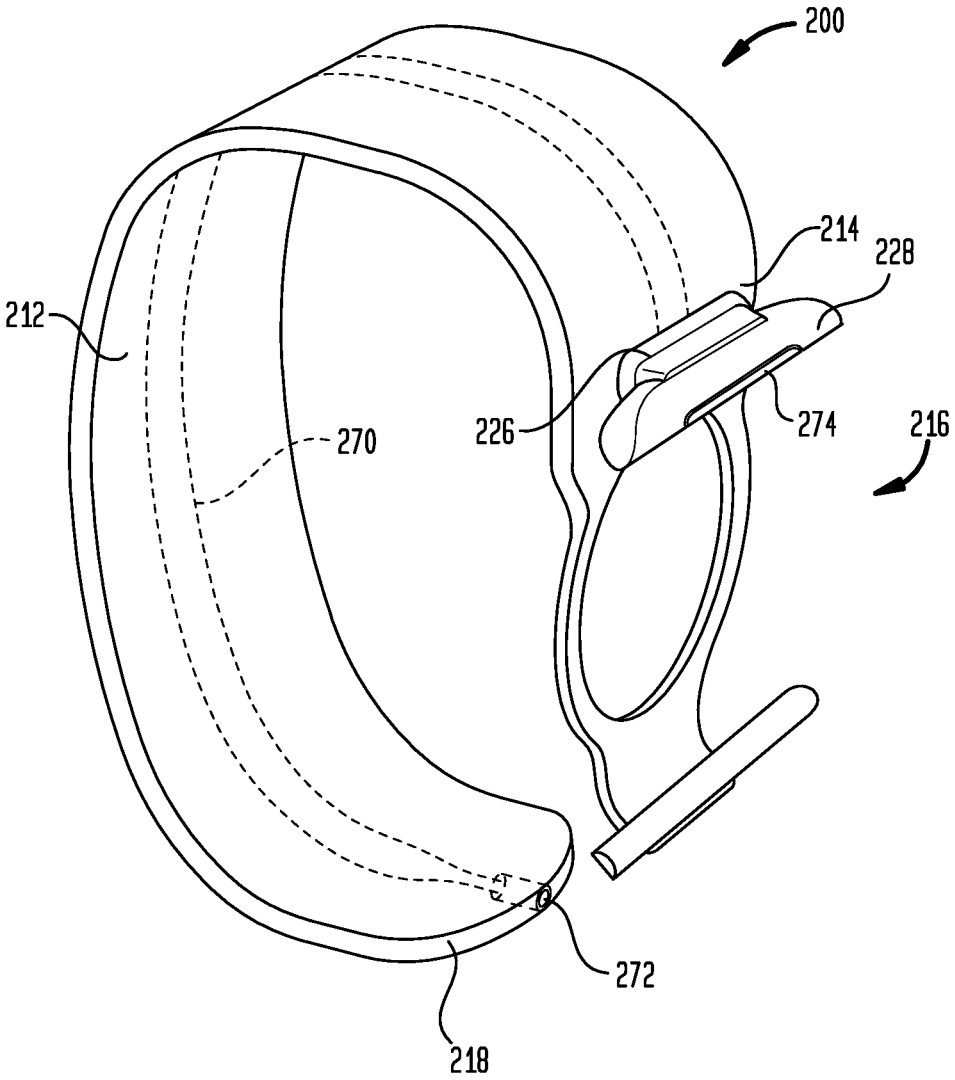
FIG. 10 is a front perspective view of a watchband according to a further embodiment of the present invention.

Further variants of the watchband according to the present invention are contemplated herein. One such variant is watchband 200 shown in FIG. 10. Watchband 200 is substantially similar to watchband 10 described above and may include all of the features of watchband 10. However, watchband 200 also includes features for electrically connecting the watchband to a power source, as well as to watch case 400. Referring to FIG. 10, watchband 200 includes one or more electrically conductive wires 270 embedded within bracelet 212 and extending along the entire length of the bracelet from end 214 to end 218 thereof. At end 218, wires 210 are connected to an electrical receptacle or connector 272. Connector 272 is adapted to receive a charging cable for supplying power to watch case 400 to charge the batteries therein. Connector 272 may also be adapted to receive an electrical communication cable for downloading data from watch case 400 to a smart phone, computer or other electronic device, or for uploading data from a smart phone, computer or other electronic device to the watch case. The other ends of electrical conductors 270 extend from bracelet 212 through stanchion 226 and bar 228 of mounting structure 216 where they connect to a conductor 274 exposed on the surface of bar 228. Conductor 274 may be in the form of a single conductive element or a plurality of conductive elements that are positioned on bar 228 so as to mate with corresponding conductive elements (not shown) in channel 402 of watch case 400. The conductive elements in channel 402 may be electrically coupled to a battery within watch case 400 for supplying a charging current to the battery from electrical connector 272, through watchband 200 and conductor 274. The conductive elements within channel 402 may also be coupled to one or more electrical components within watch case 400 so that data can be uploaded to the watch case or downloaded from the watch case via the electrical connection between conductor 274 and the watch case.

Figure 11:
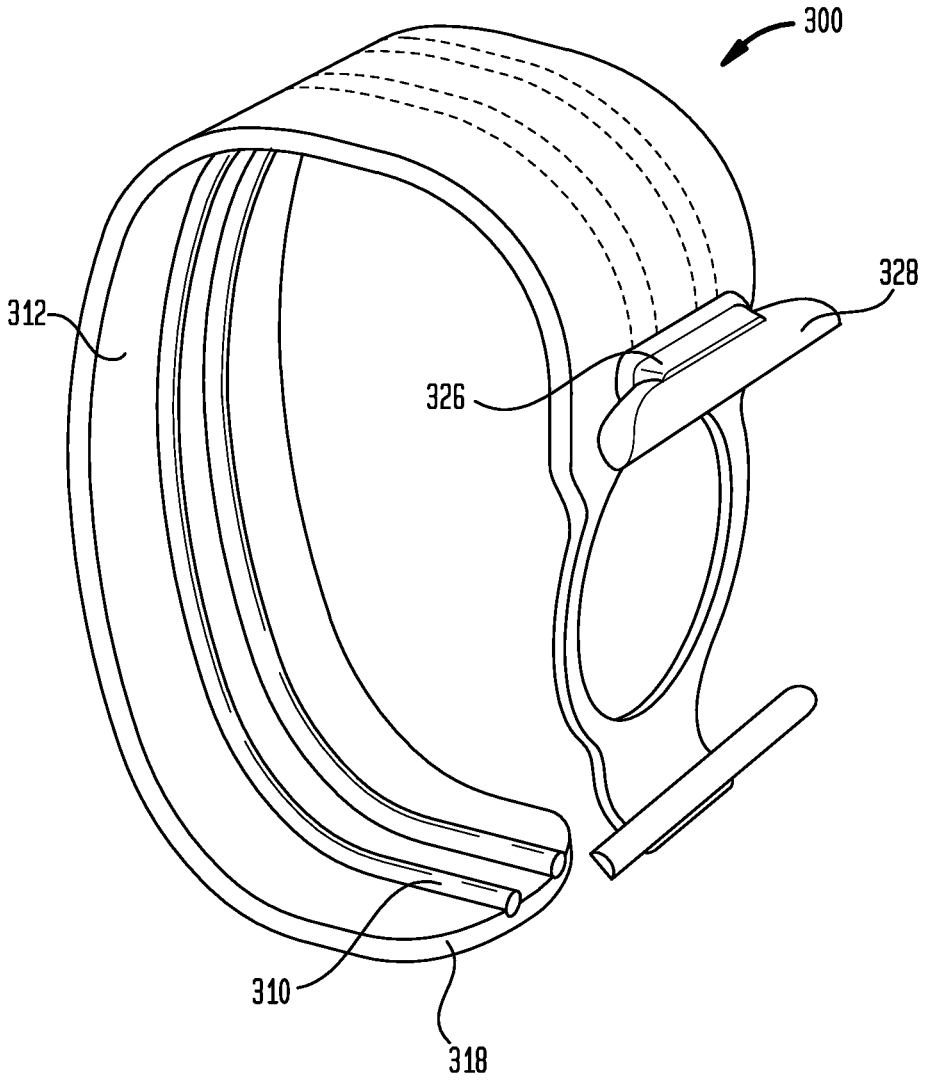
FIG. 11 is a front perspective view of a watchband according to yet another embodiment of the present invention.

Yet another variant of the watchband of the present invention is watchband 300 shown in FIG. 11. Watchband 300 is also substantially similar in structure to watchband 10 described above and may include all of the features of watchband 10. However, watchband 300 also includes one or more inflatable tubes 310 partially embedded along the inside surface of bracelet 312. One end of each tube 310 is exposed at or near the free end 318 of bracelet 312 where it can be connected to a source of pressurized air, or another gas or fluid. The other end of each tube 310 may be connected through stanchion 326 and bar 328 to a pressure measuring element, such as a piezoelectric element, within watch case 400. In this manner, when worn on a user's wrist, watchband 300 may be used to measure or monitor the user's blood pressure, pulse, etc., with a readout of any measurements being displayed on watch case 400.

To summarize the foregoing, the present invention provides a watchband for a watch case, the watch case having straight upper and lower edges, each of the edges having a channel, and a cylindrical boss protruding from a back surface of the watch case, the watchband including a mounting structure including a base having a front surface, a rear surface, an aperture extending from the front surface to the rear surface, and first and second bars connected to the base at positions spaced from the front surface; and a bracelet extending in an elongation direction between a first end connected to the mounting structure and a free end, the free end being spaced from the mounting structure, wherein the first bar is oriented parallel to the second bar in a direction orthogonal to the elongation direction of the bracelet; and/or the bracelet may be moveable from a rest position in which the free end is spaced a first distance from the mounting structure to a deflected position in which the free end is spaced a second distance from the mounting structure, the second distance being greater than the first distance; and/or the bracelet may be biased to move from the deflected position to the rest position; and/or the mounting structure may further include a first stanchion interposed between the first bar and the base of the mounting structure and a second stanchion interposed between the second bar and the base of the mounting structure; and/or the aperture in the base may be sized to receive the cylindrical boss protruding from the back surface of the watch case; and/or the watchband may be formed from a material selected from the group consisting of metals, polymers and rubber; and/or the metals may be selected from the group consisting of stainless steel, brass, copper, silver, gold, platinum and titanium; and/or the polymers may be selected from the group consisting of resin, nylon and polyester; and/or the watchband may further include a hinge positioned between a first portion of the bracelet and a second portion of the bracelet, the hinge enabling the second portion of the bracelet to rotate relative to the first portion of the bracelet; and/or the hinge may be positioned closer to the free end of the bracelet than to the first end of the bracelet; and/or the hinge may include a first plurality of teeth connected to the first portion of the bracelet and a second plurality of teeth connected to the second portion of the bracelet; and/or engagement of the first plurality of teeth with the second plurality of teeth may prevent the second portion of the bracelet from rotating relative to the first portion of the bracelet.

The present invention also provides a watch, including a watch case having straight upper and lower edges, each of the edges having a channel, and a cylindrical boss protruding from a back surface of the watch case; and a watchband, including a mounting structure including a base having a front surface, a rear surface, an aperture extending from the front surface to the rear surface, and first and second bars connected to the base at positions spaced from the front surface; and a bracelet extending in an elongation direction between a first end connected to the mounting structure and a free end, the free end being spaced from the mounting structure, wherein the first bar is oriented parallel to the second bar in a direction orthogonal to the elongation direction of the bracelet; the watch case being connected to the watchband so that the first bar is positioned in another one of the channels, the second bar is positioned in another one of the channels, and the cylindrical boss is positioned in the aperture; and/or the watchband may be formed from a material selected from the group consisting of metals, polymers and rubber; and/or the metals may be selected from the group consisting of stainless steel, brass, copper, silver, gold, platinum and titanium; and/or the polymers may be selected from the group consisting of resin, nylon and polyester; and/or the watchband may further include a hinge positioned between a first portion of the bracelet and a second portion of the bracelet, the hinge enabling the second portion of the bracelet to rotate relative to the first portion of the bracelet; and/or the hinge may be positioned closer to the free end of the bracelet than to the first end of the bracelet; and/or the hinge may include a first plurality of teeth connected to the first portion of the bracelet and a second plurality of teeth connected to the second portion of the bracelet; and/or engagement of the first plurality of teeth with the second plurality of teeth may prevent the second portion of the bracelet from rotating relative to the first portion of the bracelet.

Although the invention herein has been described with reference to particular embodiments, it is to be understood that these embodiments are merely illustrative of the principals and applications of the present invention. It is therefore to be understood that numerous modifications may be made to the illustrative embodiments and that other arrangements may be devised without departing from the spirit and scope of the present invention as defined by the appended claims.

The invention claimed is:

1. A watchband for a watch case, the watch case having straight upper and lower edges, each of the edges having a channel, and a cylindrical boss protruding from a back surface of the watch case, the watchband comprising:

a mounting structure including a base having a front surface, a rear surface, through-hole extending from the front surface to the rear surface, and first and second bars connected to the base at positions spaced from the front surface; and a bracelet extending in an elongation direction between a first end connected to the mounting structure and a free end, the free end being spaced from the mounting structure, wherein the first bar is oriented parallel to the second bar in a direction orthogonal to the elongation direction of the bracelet.

2. The watchband as claimed in claim 1, wherein the bracelet is moveable from a rest position in which the free end is spaced a first distance from the mounting structure to a deflected position in which the free end is spaced a second distance from the mounting structure, the second distance being greater than the first distance.

3. The watchband as claimed in claim 2, wherein the bracelet is biased to move from the deflected position to the rest position.

4. The watchband as claimed in claim 1, wherein the mounting structure further includes a first stanchion interposed between the first bar and the base of the mounting structure and a second stanchion interposed between the second bar and the base of the mounting structure.

5. The watchband as claimed in claim 1, wherein the through-hole in the base is sized to receive the cylindrical boss protruding from the back surface of the watch case.

6. The watchband as claimed in claim 1, wherein the watchband is formed from a material selected from the group consisting of metals, polymers and rubber.

7. The watchband as claimed in claim 6, wherein the metals are selected from the group consisting of stainless steel, brass, copper, silver, gold, platinum and titanium.

8. The watchband as claimed in claim 6, wherein the polymers are selected from the group consisting of resin, nylon and polyester.

9. The watchband as claimed in claim 1, further comprising a hinge positioned between a first portion of the bracelet and a second portion of the bracelet, the hinge enabling the second portion of the bracelet to rotate relative to the first portion of the bracelet.

10. The watchband as claimed in claim 9, wherein the hinge is positioned closer to the free end of the bracelet than to the first end of the bracelet.

11. The watchband as claimed in claim 9, wherein the hinge includes a first plurality of teeth connected to the first portion of the bracelet and a second plurality of teeth connected to the second portion of the bracelet.

12. The watchband as claimed in claim 11, wherein engagement of the first plurality of teeth with the second plurality of teeth prevents the second portion of the bracelet from rotating relative to the first portion of the bracelet.

13. A watch, comprising:

a watch case having straight upper and lower edges, each of the edges having a channel, and a cylindrical boss protruding from a back surface of the watch case; and a watchband, including:

a mounting structure including a base having a front surface, a rear surface, a through-hole extending from the front surface to the rear surface, and first and second bars connected to the base at positions spaced from the front surface; and a bracelet extending in an elongation direction between a first end connected to the mounting structure and a free end, the free end being spaced from the mounting structure, wherein the first bar is oriented parallel to the second bar in a direction orthogonal to the elongation direction of the bracelet;

the watch case being connected to the watchband so that the first bar is positioned in one of the channels, the second bar is positioned in another one of the channels, and the cylindrical boss is positioned in the through-hole.

14. The watch as claimed in claim 13, wherein the watchband is formed from a material selected from the group consisting of metals, polymers and rubber.

15. The watch as claimed in claim 14, where the metals are selected from the group consisting of stainless steel, brass, copper, silver, gold, platinum and titanium.

16. The watch as claimed in claim 14, wherein the polymers are selected from the group consisting of resin, nylon and polyester.

17. The watch as claimed in claim 13, further comprising a hinge positioned between a first portion of the bracelet and a second portion of the bracelet, the hinge enabling the second portion of the bracelet to rotate relative to the first portion of the bracelet.

18. The watch as claimed in claim 17, wherein the hinge is positioned closer to the free end of the bracelet than to the first end of the bracelet.

19. The watch as claimed in claim 17, wherein the hinge includes a first plurality of teeth connected to the first portion of the bracelet and a second plurality of teeth connected to the second portion of the bracelet.

20. The watch as claimed in claim 19, wherein engagement of the first plurality of teeth with the second plurality of teeth prevents the second portion of the bracelet from rotating relative to the first portion of the bracelet.

* * * * *